US011439858B1

(12) United States Patent
Berndt et al.

(10) Patent No.: US 11,439,858 B1
(45) Date of Patent: Sep. 13, 2022

(54) FIRE EXTINGUISHER AND METHOD

(71) Applicants: Dieter R. Berndt, Reno, NV (US); Thomas W. Berndt, Reno, NV (US)

(72) Inventors: Dieter R. Berndt, Reno, NV (US); Thomas W. Berndt, Reno, NV (US)

( * ) Notice: Subject to any disclaimer, the term of this patent is extended or adjusted under 35 U.S.C. 154(b) by 0 days.

(21) Appl. No.: 16/994,529

(22) Filed: Aug. 14, 2020

Related U.S. Application Data

(60) Provisional application No. 62/886,868, filed on Aug. 14, 2019.

(51) Int. Cl.

| | |
|---|---|
| ***A62C 99/00*** | (2010.01) |
| ***A62D 1/00*** | (2006.01) |
| ***A62C 13/64*** | (2006.01) |
| ***A62D 1/02*** | (2006.01) |
| ***A62C 2/00*** | (2006.01) |

(52) U.S. Cl.
CPC ..... *A62C 99/0045* (2013.01); *A62C 13/64* (2013.01); *A62D 1/0014* (2013.01); *A62D 1/0092* (2013.01)

(58) Field of Classification Search
None
See application file for complete search history.

(56) References Cited

U.S. PATENT DOCUMENTS

| | | | | |
|---|---|---|---|---|
| 6,235,091 | B1 * | 5/2001 | Spencer | C10L 3/108 96/242 |
| 6,352,576 | B1 * | 3/2002 | Spencer | B01D 53/1475 95/236 |
| 8,709,367 | B2 * | 4/2014 | Pinard Westendorf | B01D 53/96 423/228 |
| 8,728,599 | B2 * | 5/2014 | Fang | B32B 9/04 428/36.91 |
| 10,391,445 | B2 * | 8/2019 | Mettler | B01D 53/04 |
| 2004/0123738 | A1 * | 7/2004 | Spencer | C10K 1/00 95/236 |
| 2005/0274258 | A1 * | 12/2005 | Spencer | B01D 53/1493 95/236 |
| 2011/0185623 | A1 * | 8/2011 | Cooper | C10L 3/06 44/301 |

(Continued)

FOREIGN PATENT DOCUMENTS

| | | |
|---|---|---|
| CN | 106867033 | 6/2017 |
| CN | 113209541 A | 8/2021 |

(Continued)

*Primary Examiner* — Joseph D Anthony
(74) *Attorney, Agent, or Firm* — John D. Long, Esq.; Long & Chybik

(57) ABSTRACT

The invention comprises a fire extinguisher and method, wherein the fire extinguisher has a sealable high-pressure container that forms a hollow interior connected by a valve to an environment external to the said container. The said container holds at a high pressure at room temperature a composition of liquid carbon dioxide and a non-hydrate, hydrophobic, cyclic organo-siloxane compound, the said compound further having a freezing point of at least −20° C. at one atmosphere. Upon release of the combination to the environment external to the container, the compound further produces a clathrate. In at least one embodiment of the invention, both the clathrate and the non-hydrate, hydrophobic, cyclic organo-siloxane compound have firefighting conductive properties.

6 Claims, 2 Drawing Sheets

(56) References Cited

U.S. PATENT DOCUMENTS

| | | | | |
|---|---|---|---|---|
| 2012/0009429 | A1* | 1/2012 | Shmueli | G02B 1/18 428/447 |
| 2015/0033711 | A1* | 2/2015 | Hyde | C10L 5/363 60/281 |
| 2016/0319991 | A1* | 11/2016 | Caldeira | F17C 1/16 |
| 2018/0229178 | A1* | 8/2018 | Mettler | B01D 53/62 |

FOREIGN PATENT DOCUMENTS

| | | | |
|---|---|---|---|
| WO | WO 200604541 | A1 | 4/2006 |
| WO | WO 2021138147 | A1 | 7/2021 |

* cited by examiner

FIRE EXTINGUISHER AND METHOD

CROSS-REFERENCES TO RELATED APPLICATIONS

Applicants claim priority to the U.S. non-provisional patent application Ser. No. 62/886,868, as filed on Aug. 14, 2019.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to carbon dioxide ($CO_2$)-based fire extinguishers and their method of operation. More particularity to those carbon dioxide ($CO_2$)-based fire extinguishers that may incorporate into their carbon dioxide ($CO_2$) discharge base one or more additional compounds; may create new compounds in their plume discharge, or both that may enhance the respective discharge plume's capability in fire suppression and extinguishment.

BACKGROUND

The carbon dioxide ($CO_2$) fire extinguishers have been in use for several decades. These type of fire extinguishers may comprise a container with a hollow interior charged with or otherwise holding liquid $CO_2$ at high pressure (e.g., 800 psi at room temperature). A discharge valve may controllably connect the hollow interior to a two-ended discharge horn that will deliver and direct the extinguisher interior content to an environment outside of the extinguisher. The discharge horn may define a hollow horn interior continuously connecting an open wide end to an open narrow end. The narrow open end may hold a nozzle that connects to the discharge valve while the wide open end opens out to the outside environment.

To load or charge the cardon dioxide ($CO_2$) fire extinguisher, high-pressure liquid cardon dioxide ($CO_2$) could be introduced into the hollow interior through the discharge valve (e.g., with the discharge horn being removed from the discharge valve first). Upon substantial securement of the high-pressure liquid $CO_2$ (e.g., closing the discharge valve) within the hollow interior and the reconnection of the discharge horn to the discharge valve, the $CO_2$ fire extinguisher could be ready for use.

Upon the activation or opening of the discharge valve (e.g., squeezing a discharge valve lever and handle together), the high pressure of the liquid $CO_2$ may move the $CO_2$ out of the hollow interior though the discharge valve and into the discharge horn. In entering the discharge horn, the $CO_2$ could move through discharge nozzle. The discharge nozzle may direct the liquid $CO_2$ to an immediate interior wall of the discharge horn. During the $CO_2$'s outward movement through the discharge horn, the $CO_2$ may undergo a phase change from a liquid under a high-pressure environment (e.g., at or about room temperature, e.g., 25° C.) to an external environment of one atmosphere pressure (e.g., about 15 psi) at about room temperature. In moving between the high pressure environment and to a one atmosphere environment, the $CO_2$ may absorb heat (e.g., the liquid-to-gaseous phase change generally being an endothermic reaction) to substantially create a generally cold atmospheric environment within the discharge horn's interior by the discharge horn's nozzle (e.g., and also possibly creating a frozen water condensation upon the outside of the base of the discharge horn during fire extinguisher operations.) This cold environment of the discharge horn may provide for the formation of dry ice (i.e., frozen or solid $CO_2$) particles (e.g., being microscopic to molecular in size) within the CO2 discharge plume. This dry ice formation may be seen as enhancing the firefighting discharge (e.g., $CO_2$/dry ice plume combination.) The resulting discharge with dry ice particles may have a snowy appearance as well as a particulate projection capability to deliver the firefighting plume discharge to a fire source remote from the $CO_2$ fire extinguisher.

When directed and delivered to the fire source, the firefighting plume discharge needs to be presented in sufficient quantities to substantially displace at least one of the three legs (i.e., oxygen, heat, and fuel) needed to support a fire. Because the oxygen portion of $CO_2$ molecule cannot normally be consumed by the fire, an extinguisher $CO_2$ discharge in sufficient quantities could displace oxygen at a fire site as well as possibly displace some heat of the fire with the firefighting $CO_2$ discharge being emitted at a very cold temperature. As such, $CO_2$ fire extinguishers are generally rated as C-rated fire extinguishers (i.e., having firefighting capability for electrical and some liquid fires) by certifying authorities. It is important that such-rated fire extinguishers generally do not leave an extinguisher discharge residue that could impact or otherwise damage equipment at the fire site that is otherwise unaffected by the fire. The $CO_2$ fire extinguisher, in substantially avoiding leaving a discharge residue, generally cannot handle A or B types of fires (e.g., material and liquid fires) that may require residue-based firefighting discharges (e.g., powder or foam) to extinguisher such fires.

The $CO_2$ discharge, in avoiding leaving a residue, cannot also prevent a reignition of the fire's fuel. In comparison, A-rate fire extinguisher discharge in using particulate matter (e.g., MAP or Mono-Ammonium Phosphate) leaves a residue that may cover, coat or penetrate the fire's fuel while a C-rated fire extinguisher may use chemical foam to cover the fire's fuel. These residue discharges remove the fuel leg and provide a coating or impregnation that may prevent re-ignition of the fuel by any heat present proximate at the fire fuel. However, the MAP discharge plume may provide wide dispersement of MAP particulate deposit over objects not subject to or otherwise damaged by the fire. MAP residue deposited upon such objects may be seen as being very messy, costly and difficult to remove post-fire. Further, MAP residue deposited upon electrical and other equipment that were otherwise unaffected by the fire may do serious damage to said equipment.

Other possible limitations of the $CO_2$ fire extinguisher could be a limited dwell time or the amount of time the fire extinguisher provides active firefighting discharge relative to its weight (e.g. size). For example, a 5-pound $CO_2$ extinguisher may have an operational time of 15-20 seconds before the viable amount/internal pressure of $CO_2$ drops to a level where the white discharge plume may loses it snowy appearance. At that time, the $CO_2$ extinguisher discharge may contain ineffective firefighting amounts of $CO_2$; insufficient $CO_2$ pressure and particularization (dry ice) to effective fight the fire source (e.g., the fire extinguisher just fizzles).

The firefighting heart of $CO_2$ fire extinguishers could be the carbon dioxide's physical properties, especially the compound's phase-changing properties (e.g., moving between a gaseous state, a liquid state and a solid state [e.g., dry ice]) as affected by the atmospheric pressure at which the $CO_2$ exists. At one atmospheric pressure, when gaseous carbon dioxide ($CO_2$) is significantly chilled (e.g., to a temperature of −109.3° F. or −78.5° C. or 194.65° K) the gaseous carbon dioxide ($CO_2$) generally does not condense or pass into a liquid form but may directly form or deposit into a solid phase $CO_2$ or dry ice. Conversely, when the solid carbon dioxide (e.g., dry ice) warms above −78.5° C. at one atmosphere, the dry ice or solid $CO_2$ does not phase change into a liquid, rather the solid $CO_2$ substantially moves directly to or sublimates into gaseous $CO_2$.

When the solid $CO_2$ is subject to much high pressures (e.g., several atmospheres or 800 psi or above) and is warmed up, the solid $CO_2$ may move through the intermediate phase change or liquid form before moving onto the gaseous state. When liquid $CO_2$ (e.g., of a $CO_2$ fire extinguisher at room temperature) is released from its containment of several atmospheres of pressure to one atmosphere, the liquid solid $CO_2$ generally goes into directly into gaseous state. In phase changing from a liquid state, the liquid carbon dioxide may absorb heat, and in doing so creates a cold gaseous environment that could form particulate solid $CO_2$ discharge.

What may be needed to overcome these limitations could be the present invention that may comprise a fire extinguisher system whose extinguisher composition is liquid $CO_2$ combined with a non-hydrate, hydrophobic, cyclic organo-siloxane compound that upon discharge could form a hydrophobic and anhydrous clathrate with firefighting capabilities. Most known clathrates can be considered as a type of hydrate, or water compound, in which molecules of another substance are trapped within a lattice cage-like structure composed of water molecules. The trapped molecule is usually a gas at normal pressure and temperature. Many clathrates may be ice-like solids that generally form at high pressures and low temperatures. Among the best known and most studied clathrate is a methane hydrate that occurs naturally in large deposits in great pressures under the deeply submerged seabeds.

Most clathrates may have a dodecahedron form composed of 20 water molecules arranged to form 12 pentagonal faces, with a hollow center that can be occupied by "guest molecules." The clathrate structure is substantially held together by hydrogen bonds between the water molecules but may be further stabilized by the guest molecules. Since the dodecahedra cannot be packed together to fill all the available space, hence other polyhedral shapes may also occur, so that a lattice is formed. Due to this variation in the cage shapes, and the fact that not all the cages are necessarily occupied, clathrates may not be given precise chemical formulae. Clathrate guest molecules can be hydrocarbon gases, such as methane or ethane, and non-polar atmospheric gases i.e. oxygen, nitrogen and carbon dioxide.

The invention in providing a clathrate discharge plume could increase a dwell time of $CO_2$ type fire extinguisher; generally augment a $CO_2$ type fire extinguisher capabilities to obtain multiple fire ratings; generally provide a fire extinguisher with a $CO_2$ discharge plume with a heat-activated clathrate that when deposited upon a heated object (e.g., heated by the fire), the clathrate will provide an inert fire smothering agent to further isolate fuel from the fire; substantially prevent reignition of the fire; generally provide a discharge plume that otherwise harmlessly dissipates into the atmosphere if the discharge plume does not contact heated surface(s); generally does not leave discharge residue on items otherwise not affected or heat damaged by the fire; could decrease the difficultness, cost and time to clean up after the fire is extinguished; and could provide a discharge plume that projects for a greater distance and has a low environmental impact.

SUMMARY OF ONE EMBODIMENT OF THE INVENTION

Advantages of One or More Embodiments of the Present Invention

The various embodiments of the present invention may, but do not necessarily, achieve one or more of the following advantages:

to provide a firefighting clathrate structure that provides a frozen or solidified micro particles that fire extinguisher discharge plume can allow the said plume to be propelled to a larger distance than proved by an ordinary $CO_2$ fire extinguisher;

the ability to allow a clathrate enhancement of the $CO_2$ fire extinguishers to allow such extinguishers to handle A type fires;

to provide a clathrate enhanced $CO_2$ fire extinguisher with a discharge smothering capability that prevents reignition of fuels that could be the basis of class A, B and C fires;

the ability to increase a clathrate enhanced $CO_2$ fire extinguisher's heat-sink effectiveness for "A" fuels and burning materials because of a clathrate's inherent temperature lowering ability;

to provide a clathrate-based firefighting discharge structure that could deliver more $CO_2$ asphyxiating gas from high-pressure state to a low-pressure flame site for a more efficient fire extinguishment;

the ability to form a firefighting cyclopentasiloxane based clathrate structure that is more directable and projectable towards a flame source and is more capable of being injected into a type A flame source allowing the clathrate to decompose to nano-silicone dioxide and carbon dioxide wherein the nano-silicone dioxide generally coats and seals off the type A fire fuel from the flame to prevent ignition, reignition or both;

provide a clathrate-based firefighting composition that may decompose into nano-silicone dioxide upon contacting materials heated by fire but not in the cooler fire perimeter, thus substantially leaving no composition residue upon structures that are generally not affected by heat of the fire;

providing a fire fighting composition comprises of EPA approved non-VOC (Volatile Organic Compounds) and otherwise considered non-toxic by NIOSH (CDC) and OSHA;

the ability to enhance the carbon dioxide delivery capability of firefighting systems; and providing a compact, lighter and more efficient firefighting system that individual firefighters can bring to a fire source.

These and other advantages may be realized by reference to the remaining portions of the specification, claims, and abstract.

Brief Description of One Embodiment of the Present Invention

A homologous composition comprising carbon dioxide and decamethylcyclopentasiloxane, both compounds being held in a liquid phase at a pressure of 800 psi or greater to enhance the heatsink effectiveness of carbon dioxide by itself.

A composition comprising carbon dioxide and a cyclopentasiloxane, wherein the composition is held at an initial pressure to maintain carbon dioxide in a liquid phase, the liquid composition being subsequently subject to a second pressure that is less than the initial pressure to the extent that carbon dioxide solidifies and becomes a guest compound of a cyclopentasiloxane solid forming a resulting anhydrous clathrate.

A composition comprising carbon dioxide and a cyclopentasiloxane, wherein the composition is held at an initial set of environmental conditions that provide carbon dioxide and the cyclosiloxane are both in a liquid phase, the composition being subsequently subject to a second set of environmental conditions wherein that both carbon dioxide and the cyclopentasiloxane both solidify allowing the solid carbon dioxide becomes a guest compound of a host compound solid cyclopentasiloxane to form an anhydrous clathrate.

A fire extinguisher comprising of a body with an exterior defining a hollow interior, a connection between the hollow interior and exterior controlled by a valve that otherwise allows the venting of the hollow interior to an outside atmosphere, the hollow interior further containing a liquid composition comprising carbon dioxide and a cyclopentasiloxane at an initial high pressure.

A method of using a fire extinguisher comprising of the steps: providing a body with an exterior defining a hollow interior, a connection between the hollow interior and exterior controlled by a valve that otherwise allows the venting of the hollow interior to an outside atmosphere, the hollow interior further containing a liquid composition comprising carbon dioxide and another compound at high pressure; activating the valve to vent the hollow interior to an outside atmosphere, forming a clathrate.

A method of using a fire extinguisher comprising following the steps: providing a body with an exterior defining a hollow interior, a connection between the hollow interior and exterior controlled by a valve that otherwise allows the venting of the hollow interior to an outside atmosphere, the hollow interior further containing a liquid composition comprising carbon dioxide and another compound at high pressure; activating the valve to vent the hollow interior to an outside atmosphere, forming a clathrate; depositing the clathrate upon a material supporting the fire combustion, decomposing the clathrate upon the said material to form a fire suppressing coating upon heated portions of the material.

A method of extinguishing comprising the following steps a fire providing a fire extinguisher comprising a body with an exterior defining a hollow interior, a connection between the hollow interior and exterior controlled by a valve that otherwise allows the venting of the hollow interior to an outside atmosphere, the hollow interior further containing a liquid composition comprising first compound had a second compound, the two compounds having different chemical properties; activating the valve to vent the hollow interior to an outside atmosphere, forming a firefighting discharge plume that leaves silicon dioxide on a fire heated surface or otherwise dissipates in into the outside atmosphere without leaving a residue.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
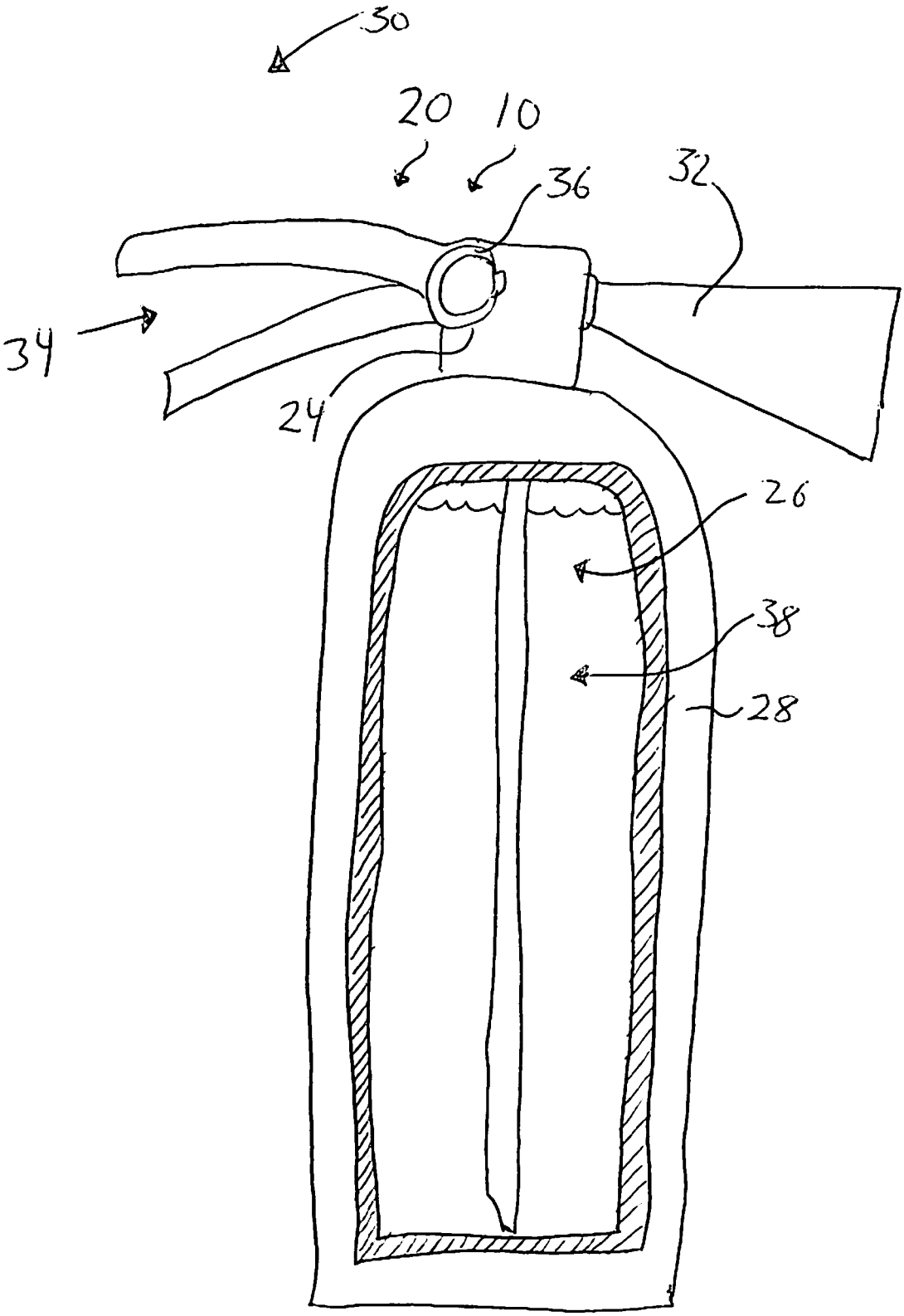
FIG. 1 is substantially a cutaway elevation view of one embodiment of fire extinguisher of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized, and structural changes may be made without departing from the scope of the present invention.

The present invention could be a firefighting system comprising of new firefighting composition, the use of the composition could create a new clathrate within a discharge plume, and the new clathrate within a discharge plume could provide enhanced firefighting capabilities.

Firefighting Composition

The firefighting composition could be homologous and could be formed by combining a at high pressure at room temperature a non-hydrate, hydrophobic, cyclic organo-siloxane compound and non-polar atmospheric gas together. In one embodiment, the non-hydrate, hydrophobic, cyclic organo-siloxane compound could have at least a freezing point of at least −20° C. at one atmosphere. In at least one embodiment of the invention, the hydrophobic, cyclic organo-siloxane compound could be a cyclopentasiloxane. In at least one version, cyclopentasiloxane could be decamethylcyclopentasiloxane or dodecamethylcyclopentasiloxane $C_{10}H_{30}O_5Si_5$

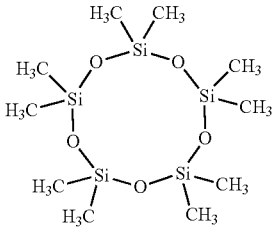

In at least one embodiment, the non-polar atmospheric gas could be carbon dioxide (liquid).

In at least one embodiment of the invention, the composition could have a percentage ratio of at least 12 liquid ounces of decamethylpentacyclosiloxane to 40 liquid ounces of liquid carbon dioxide, the composition being initially pressurized to at least 800 psi.

Decamethylcyclopentasiloxane may be considered decahedron-pentagonal ring structure having 3-D (10) pentagonal faces of silicon and oxygen with a hollow center that can also be occupied by a "guest molecule" such as $CO_2$ in a manner similar to the dodecahedra formation of water molecules (as in hydra-based clathrates) providing a space for "guest" molecules typically non-polar gases, i.e. $CO_2$, $O_2$, $N_2$, etc. Decamethylcyclopentasiloxane, also known in literature as D5, is a well-known, environmentally friendly ring compound that is one of the most common ingredients used in personal care and cosmetic products (as a skin emollient and cosmetic delivery agent) as well as being a key ingredient used in environmentally friendly (Green) high pressure dry cleaning systems.

When hydrophobic, cyclic organo-siloxane compound (e.g., liquid decamethylcyclopentasiloxane [$C_{10}H_{30}O_5Si_5$]) and non-polar atmospheric gas (e.g., liquid carbon dioxide ($CO_2$) are combined substantially under high pressure and room temperature, the resulting composition upon discharge may have potentially good firefighting capabilities. Both compounds are anhydrate, generally ensuring good homogenous mixture when combined. At −110° C., the liquid CO2 instantly sublimes to dry ice while hydrophobic, cyclic organo-siloxane also occurs at a solid phase at that temperature as well (e.g., decamethylcyclopentasiloxane [C10H30O5Si5) has freezing temperature of −40° C.) helping create the clathrate and further provide for snowy discharge plume. Further, at 300° C. and above, the decamethylcyclopentasiloxane will decompose into methane, carbon dioxide and silica dioxide ($SiO_2$). Below 300° C., decamethylcyclopentasiloxane generally evaporates rather than decompose.

Fire Extinguisher

A substantially shown in FIG. 1, the fire extinguisher embodiment of the invention 10 could generally be built to industry, certification and government established structural parameters for carbon dioxide ($CO_2$) fire extinguishers. This embodiment could comprise a fire extinguisher body 20 having a cylindrical container 22 sealable by a valve 24, the valve 24 controllably connecting a hollow container interior 26 defined by the container exterior 28 to an external environment 30. The valve 24 could further controllably connect the hollow container interior 26 to a conical discharge tube or horn 32. The valve 24 can be operated by a handle/movable lever combination 34 guarded by a removably inserted safety pin 36 proximately engaging the valve 24.

As noted above, cyclopentasiloxane (e.g., decamethylpentacyclosiloxane) which is in a liquid state at one atmosphere and room temperature can be loaded into the cylinder interior first. Then liquid carbon dioxide pressurized at more than 800 psi (and at room temperature) is loaded into the cylinder interior as well. Once both compounds are loaded into the cylinder to form the composition 38, the container 22 is sealed (via the valve 24) at high pressure (e.g., 850 psi) and the horn is connected to the valve.

When the extinguisher embodiment is activated, an operator (not shown) can remove the safety pin 36 from the valve, can operate the handle-lever combination 34 with the other hand and then point an open wide end of the discharge horn 32 in the direction of the fire. Moving the lever connects the pressurized composition 38 to the discharge horn 32 to form the discharge plume 40. The operator can then direct the discharge horn 32 to direct discharge plume 40 to a base of fire (e.g., base of the fire fuel).

Clathrate

The present invention could use the fire extinguisher composition to substantially create a new clathrate with firefighting capabilities in the discharge plume. This formed clathrate could be a cyclopentasiloxane/carbon dioxide clathrate, that is not considered to a hydrate, but rather hydrophobic and anhydrous. When the liquid decamethylcyclopentasiloxane and liquid CO2 are combined under high pressure, the resulting firefighting homologous composition may held within a sealable vessel (e.g., cylindrical container) that is pressurized to at least 800 psi (preferably to 850 psi.) Under these circumstances, it is believed that an inclusion composition stage is set for creating the firefighting clathrate structure as a suspension of aerodynamic nano/micro-sized particle structures. The clathrate could be seen as being a lattice or cage-type of chemical structure wherein the lattice structure formed of host or inclusion molecules (e.g., decamethylcyclopentasiloxane) that could trap guest molecule(s) (e.g., frozen $CO_2$) within a cavity defined by the lattice structure. The definition of host or inclusion molecules my be very broad, extending as well as to those channels formed between inclusion molecules making up the crystal lattice in which guest molecules can fit.

In this particular embodiment, the decamethylcyclopentasiloxane via its ring structure may be suitable to form a solid host structure that creates a lattice with a cavity that retains solid carbon dioxide as a guest molecule to form a cyclopentasiloxane/carbon dioxide clathrate. The clathrate formation could occur with an energy transfer between the liquid $CO_2$ to liquid decamethylcyclopentasiloxane during the phase change of liquid $CO_2$ that occurs during the sudden pressure drop when the liquid $CO_2$/decamethylcyclopentasiloxane composition moves from a high pressurization within the sealable vessel contained $CO_2$ (e.g., 800 or more psi) to the one atmosphere pressure (about 15 psi) of the outside environment (e.g., external to the vessel.) This energy transfer could create the necessary cold environment that provides the particulate solid $CO_2$ (e.g., dry ice) and the solid decamethylcyclopentasiloxane needed for the creation of the cyclopentasiloxane/carbon dioxide clathrate. The cyclopentasiloxane/carbon dioxide clathrate particles, as discharge plume, forms a dense white fog or cloud that is much denser that provided by the pure carbon dioxide dry ice particle formation. The composition discharge plume also reached fire fuel placed at a greater distance than normally could be expected of a similar ordinary CO2 fire extinguisher. The composition discharge plume also exceeded the dwell time of a discharge plume of a regular CO2 fire extinguisher.

The unexpected existence of this clathrate as created by the fire extinguisher composition was determined when fire testing a $CO_2$ type fire extinguisher containing the composition. At the end of one such fire test, when the discharge horn was pointed to the ground, a frozen aggregate of the composition unexpectedly fell out of the discharge horn and dropped upon the ground. It was initially theorized that generally enclosed end of the discharge horn, substantially being conducive to the creation of subzero environment, had allowed an accumulation or aggregation of dry ice to form and fall out. Instead of acting as normal dry ice and slowly sublimating gaseous carbon dioxide generally from the dry ice structure, the frozen aggregate unexpectedly appeared to be bubbling or effervescing along frozen aggregate's bottom edge next to the warm pavement. This kind of decomposition, along the above-described physical properties of the two compounds, indicated that decamethylcyclopentasiloxane and carbon dioxide composition had formed a clathrate. The observed bubbling was not a dry ice sublimation per se, rather the frozen aggregate bubbling was effervescing $CO_2$ gas and free flowing cyclopentasiloxane (e.g., decamethylcyclopentasiloxane) fluid separating from one another as the formed clathrate decomposed at one atmosphere and at basically room temperature.

Firefighting Characteristics

The invention's discharge plume, if the clathrate comes into contact with heated (e.g., by fire) surface, may have additional firefighting capabilities. When decamethylcyclopentasiloxane was observed being used in a high-pressure, green, dry-cleaning system and was sent thorough pipe into contact with a heated environment, it would be noted that that the pipe would repeatedly clog up and not allow passage of the decamethylcyclopentasiloxane. Upon examination of the pipe interior, it was found that when cyclopentasiloxane passed through the heated portion of the pipe began to decompose. During decamethylcyclopentasiloxane decomposition, methane and carbon dioxide were released as well as the precipitation of nano-particulate solid silica dioxide ($SiO_2$) also known as nano-amorphous silica or sand. Sand, along with water, is known as one of the oldest firefighting materials.

As such, it is believed that when the cyclopentasiloxane/$CO_2$ clathrate comes into a contact with a heated surface (via contact with a fire extinguisher's discharge plume), the clathrate begins to disintegrate and releases the otherwise captive $CO_2$ (e.g., for firefighting oxygen displacement) and decamethylcyclopentasiloxane (e.g., to impregnate and coat actual and potential fire fuel). If the coated structures are heated or become subsequently timely heated (e.g., above 300° C.), then the clathrate methyl groups may be consumed with the remaining decamethylcyclopentasiloxane portions being releasing as silicon dioxide ($SiO_2$) also known as nano-amorphous silica or sand.

As observed in fire testing of the invention, the deposited sand covering generally forms a powder-like, fire-resistant coating to isolate the fuel from the fire to extinguish the fire as well as preventing a later reignition of the coated fuel. In this manner, the clathrate as created and delivered by the fire extinguisher discharge plume can act as smothering agent that can allow the clathrate enhanced $CO_2$ fire extinguisher to be uprated and be used on A-type material fires. In some firefighting circumstances, discharge procedure for the invention may require certain firefighting applications to establish the powder-like fire resistant coating without over spraying the coating with new amount of clathrate.

If the discharge plume clathrate does not come into contact with a heated (surface (e.g., fire related) and the cyclopentasiloxane/$CO_2$ clathrate warms above 300° C., the clathrate will generally decompose or evaporate to release the cyclopentasiloxane and $CO_2$ into the atmosphere in a non-environmentally harmful manner in keeping with the cyclopentasiloxane well-known uses. In this manner, the use of the invention may avoid the expense, difficulty and time for an after-fire residue cleanup and damage as caused by MAP or foam-type fire extinguishers.

Fire Suppression Testing

To first test the potential firefighting ability of decamethylcyclopentasiloxane, the liquid decamethylcyclopentasiloxane by itself was applied to cover and possibly penetrate a portion of a wooden fuel structure (e.g., A-1 crib wood fire [representing 1 cubic feet of surface area]). When the wooden fuel structure was set on fire, the intensity of the resulting fire heated the coated decamethylcyclopentasiloxane and caused the decamethylcyclopentasiloxane to breakdown or decomposes (rather than evaporate.) In doing so, the decamethylcyclopentasiloxane created a whitish-gray particulate dust-like film (e.g., a nano silica dioxide) upon the coated portions of the wooden fuel structure. When fire was subsequently extinguished and a relite attempted, the formed silica oxide coating prevented ignition of the that portion of the covered fire fuel (e.g., by separating oxygen from the fire fuel.) The reignition prevention capability of the decamethylcyclopentasiloxane is a property otherwise singularly lacking in standard $CO_2$ firefighting.

The decamethylcyclopentasiloxane that was applied to and coated fire fuel but was not heated (e.g., activated or decomposed) by the fire, there appeared to be no trace of the compound in due time under normal circumstances (e.g., room temperature, one atmosphere.) This observation may indicate that the undecomposed (non-heat activated) decamethylcyclopentasiloxane simply evaporated away, leaving the formerly coated and unheated fire fuel portion unharmed. This is a key property of $CO_2$ firefighting systems, that unheated portions of B-type firefighting systems do not otherwise damage with residue those portions of materials (especially electrical/electronic equipment) otherwise unharmed by the fire.

To further test the operation of the invention's composition, cyclopentasiloxane (e.g., decamethylcyclopentasiloxane) was loaded (poured) into a high-pressure sealable container (i.e., an empty CO2 fire extinguisher container though an open fire extinguisher valve). The cyclopentasiloxane was loaded at room temperature and at one atmosphere (i.e., the atmospheric pressure existing at sea level which is a just little less than 15 psi) in a liquid phase. Liquid carbon dioxide (generally held under much higher pressure than the cyclopentasiloxane at this time [such as 800 or more such as psi-850 psi]) could subsequently loaded into the high-pressure container. The handle on the valve was released to removably seal the container. The discharge horn was reattached to the valve. The formed composition appeared to be homogenous and otherwise uniformly mixed, with a high potential for stable shelf.

Another wooden stacked fire fuel structure was ignited and allowed to be fully engulfed. The discharge horn was directed at the fire, the horn handle/lever were grasped to release the composition and the resulting discharge plume quickly extinguished the materials fire, something a regular $CO_2$ fire extinguisher on a previous attempted fire test could not do. The discharge plumb left a gray non-evaporative, particulate deposit where the fire had ignited and burned on the wood. When a relite of the fire fuel was attempted, reignition of the fire fuel was not possible where there was the silica dioxide gray deposited on the previously heated fuel source.

Figure 2:
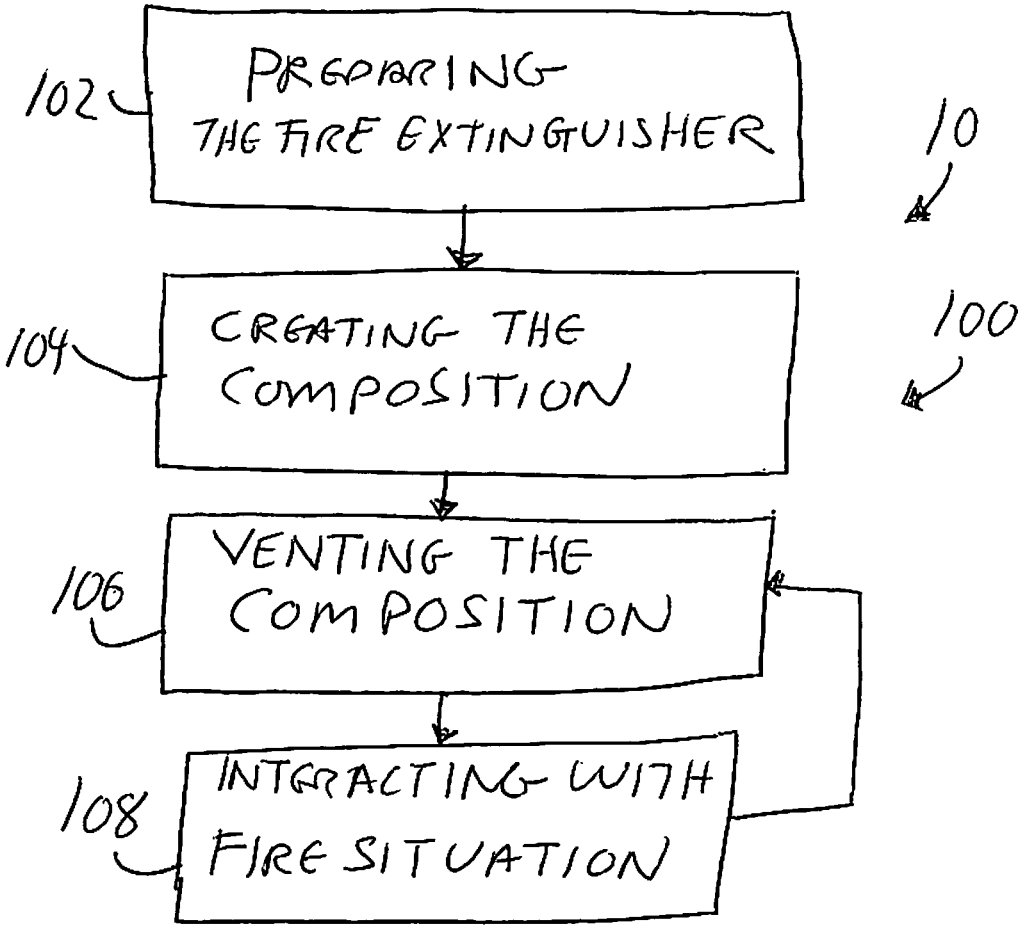
FIG. 2 is substantially a flow chart schematic for of one embodiment of the method for operating the present invention.

Process:

A substantially shown in FIG. 2, one possible method or process 100 of operation of the invention could start with step 102 preparing the vessel. This step could commence with procuring and preparing a sealable high pressure vessel or container (e.g., a basic $CO_2$ fire extinguisher tank). The tank could further define a hollow interior whose access to an environment external to the tank is controlled by a valve connected to the hollow interior. A discharge horn could be connected by a narrow nozzle end to the valve. The discharge horn could be disconnected from the valve and the valve could be opened to provide controlled access from the outside environment to the hollow interior. The discharge valve could be removed from the valve.

Liquid hydrophobic, cyclic organo-siloxane compound (e.g., decamethylcyclopentasiloxane) and liquid (pressurized) carbon dioxide) could also be suitable procured as well.

As this step is substantially completed the process 100 could continue to the step 104, creating the composition, At step 104, creating the composition, the hydrophobic, cyclic organo-siloxane compound (e.g., decamethylcyclopentasiloxane) could be loading (e.g., pouring) through the open valve. The cyclopentasiloxane could be loaded into the hollow interior at room temperature and at one atmosphere (i.e., the atmospheric pressure existing at sea level which may be just little less than 15 psi) in a liquid phase. Then high-pressure, liquid carbon dioxide (generally held under much higher pressure than the cyclopentasiloxane at this time [such as 800 or more psi-850 psi]) could subsequently loaded (through suitable liquid carbon dioxide delivery apparatus connected to the open valve) into the hollow interior of the high-pressure container. The high-pressure container may then be sealed (via the valve) at 800 or more psi (e.g., 850 psi) for optimal clathrate forming operations. The discharge horn may then be reassembled upon the closed valve. It is believed that the cyclopentasiloxane/carbon dioxide liquid composition is both homologous and long-term stable under these conditions and can be stored at room temperature. After this step substantially completed, the process 100 could proceed to 106, venting the composition.

At step 106, venting the composition. The discharge horn is aimed at the intended target (base of a suitable fire.) The valve is opened, internal pressure propels the composition through the valve providing a controlled flow rate. The composition is vented to the nozzle (otherwise enclosed end) of the discharge horn when the composition hits the wall of the discharge horn wherein the liquid carbon dioxide upon reaching the one atmosphere outside environment, absorbs heat to create a super cooling (−110 degrees C.) conditions in the enclosed end of the discharge horn. In this supercooled environment, both carbon dioxide and cyclopentasiloxane [e.g., decamethylcyclopentasiloxane] freeze into respective particulate solids (micro-to-nano particulates. The cyclopentasiloxanes' frozen state may present a solid dodecahedron (polyhedral) shape (e.g., the lattice structure with denoted cavity) at one atmospheric pressure to substantially trap solid carbon dioxide as the guest molecules. This action resulting in the formation of particulate clathrate with the resulting extinguishing discharge being a suspension of aerodynamic nano/micro-sized particle structures forming a cold white fog. The pressure of the carbon dioxide pushes the aerodynamic nano/micro-sized particle structures, as directed by the direction of the discharge horn, to the fire. At the substantial conclusion of this step, the process 100 could proceed to step 108, interacting with the fire situation.

Step 108, interacting with the fire situation, the clathrate particles could contact materials proximate to the fire situation. If the formed clathrate reaches fire-heated materials, the clathrate disintegrates releasing fire suppressing gaseous $CO_2$ and depositing the cyclopentasiloxane [e.g., decamethylcyclopentasiloxane] upon the heated materials. If the heated materials are heated to 300 C degrees or more, the upon deposit, the cyclopentasiloxane [e.g., decamethylcyclopentasiloxane] decomposes to release hydrocarbons and methane, but more importantly, deposits silica dioxide upon the heated surface. This deposited coating or covering isolates oxygen from the fire fuel to knock one legs of the fire triangle to prove fire extinguisher. The coating also aides in fire suppression by maintain this oxygen isolation solution to provide fire suppression to prevent subsequent re-ignition of the fire fuel.

If the clathrate contacts the surface of material heated to less than 300 C Degrees, the clathrate disintegrates releasing carbon dioxide and cyclopentasiloxane [e.g., decamethylcyclopentasiloxane]. The decamethylcyclopentasiloxane evaporates rather than disintegrates, and does not leave any residue (e.g., silica dioxide) upon the material surface not otherwise harmed by the fire.

The fire extinguisher is discharged until the fire is brought under suitable control. At that time, the spring-loaded lever could be released to close the valve again. At the substantial conclusion of this step, the process 100 could proceed back to step 106 as needed.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As disclosed within, the invention could increase a dwell time of $CO_2$ type fire extinguisher; generally augment a $CO_2$ type fire extinguisher capabilities to obtain multiple fire ratings; generally provide a fire extinguisher with a $CO_2$ discharge plume with a heat-activated clathrate that when deposited upon a heated object (e.g., heated by the fire), the clathrate will provide an inert fire smothering agent to further isolate fuel from the fire; substantially prevent reignition of the fire; generally provide a discharge plume that otherwise harmlessly dissipates into the atmosphere if the discharge plume does not contact heated surface(s); generally does not leave discharge residue on items otherwise not affected or heat damaged by the fire; could decrease the difficultness, cost and time to clean up after the fire is extinguished; and could provide a discharge plume that projects for a greater distance and has a low environmental impact.

What is claimed is:

1. A clathrate comprising a non-hydrate, hydrophobic, cyclic organo-siloxane compound and a non-polar atmospheric gas.

2. The clathrate of claim 1, wherein the non-polar atmospheric gas is carbon dioxide.

3. The clathrate of claim 1, wherein the non-hydrate, hydrophobic, cyclic organo-siloxane compound is cyclopentasiloxane.

4. The clathrate of claim 1, wherein the non-hydrate, hydrophobic, cyclic organo-siloxane compound is decamethylcyclopentasiloxane.

5. The clathrate of claim 1, wherein upon the clathrate's contact with a heated surface, the clathrate deposits silicon dioxide upon the heated surface.

6. The clathrate of claim 1, wherein non-hydrate, hydrophobic, cyclic organo-siloxane compound is decamethylcyclopentasiloxane and a non-polar atmospheric gas is carbon dioxide and the composition having a percentage ratio of 40 liquid ounces of a liquid carbon dioxide to at least 12 liquid ounces of decamethylcyclopentasiloxane.

* * * * *